US009073074B2

(12) United States Patent
Cheng

(10) Patent No.: US 9,073,074 B2
(45) Date of Patent: Jul. 7, 2015

(54) FRAGRANCE DISCHARGING TOILET SEAT COVER DISPENSING DEVICE

(76) Inventor: Paul Cheng, City of Industry, CA (US)

( * ) Notice: Subject to any disclaimer, the term of this patent is extended or adjusted under 35 U.S.C. 154(b) by 184 days.

(21) Appl. No.: 13/506,017

(22) Filed: Mar. 20, 2012

(65) Prior Publication Data

US 2013/0248610 A1 Sep. 26, 2013

(51) Int. Cl.

| | |
|---|---|
| ***A47K 13/14*** | (2006.01) |
| ***B05B 15/00*** | (2006.01) |
| ***A47K 13/16*** | (2006.01) |

(52) U.S. Cl.

CPC ..... *B05B 15/00* (2013.01); *A47K 13/165* (2013.01)

(58) Field of Classification Search

CPC ..... A47K 13/165; A47K 13/14; A47K 13/16
USPC ..... 4/244.1–245.9, 228.1; 206/233
See application file for complete search history.

(56) References Cited

U.S. PATENT DOCUMENTS

| | | | | | |
|---|---|---|---|---|---|
| RE17,645 | E | * | 4/1930 | Barker et al. | 4/244.2 |
| 4,513,862 | A | * | 4/1985 | Mallow | 206/233 |
| 4,598,664 | A | * | 7/1986 | Hamlin | 118/325 |
| 4,944,046 | A | * | 7/1990 | Huh et al. | 4/244.1 |
| 5,381,984 | A | * | 1/1995 | Hindsgual | 242/613.5 |
| 6,484,328 | B1 | * | 11/2002 | Frazier | 4/661 |
| 2010/0270415 | A1 | * | 10/2010 | Eakin | 242/598.5 |

OTHER PUBLICATIONS

Internet Website http://zhmy.en.alibaba.com/product/1663803977-212451240/Toilet_Cover_Seat_Paper.html#!, visited on Feb. 19, 2015 (7 pages).

Internet Website http://www.changhuapaper.en.alibaba.com/product/339220839-209959897/paper_toilet_seat_cover.html#!, visited on Feb. 19, 2015 (2 pages).

Internet Website http://www.tellingpaper.net/sdp/1265585/4/pd-5610465/7466246-2199432/1_2_Fold_Toilet_Paper_Seat_Cover.html, visited on Feb. 19, 2015 (2 pages).

Photographs of a package of Fort James Safe T Gard® toilet seat covers being opened and the individual toilet seat covers separated. Photographs taken Feb. 2015. (4 pages).

* cited by examiner

*Primary Examiner* — Huyen Le
*Assistant Examiner* — Christine Skubinna
(74) *Attorney, Agent, or Firm* — Ladas & Parry, LLP

(57) ABSTRACT

A device discharges fragrance during the dispensing of toilet seat covers generally includes a retainer for holding the toilet seat covers and at least one scent reservoir. The scent reservoir is disposed in the inside of the retainer and in contact with the toilet seat covers. At least one opening is also disposed in the retainer and defines an opening for dispensing the seat covers and discharging fragrance.

In the process of usage of the seat cover, a user removes the seat cover from the retainer by pulling the seat cover through the opening. The pulling of the seat cover creates friction on the scent reservoir and enables the fragrance particles to be released. The fragrance air flows out from the opening with the seat cover and disburses scented air into the ambient air.

6 Claims, 6 Drawing Sheets

FRAGRANCE DISCHARGING TOILET SEAT COVER DISPENSING DEVICE

CROSS-REFERENCE TO RELATED APPLICATIONS

None

FEDERALLY SPONSORED RESEARCH

None

SEQUENCE LISTING OR PROGRAM

None

FIELD OF THE INVENTION

The present invention generally relates to fragrance discharging devices and more specifically relates to a device that discharges fragrance during the dispensing of the toilet seat covers. The fragrance is discharged in accordance with the device of this invention by causing a disbursement of scented air from within the device, and thereafter, permeates through the environment surrounding the device.

BACKGROUND OF THE INVENTION

The usage of toilet seat covers is widely practiced for hygienic reasons. As such, the toilet seat covers are prevalent in certain public bathrooms. In the bathrooms, a packet of toilet seat covers is generally placed in close proximity of a toilet bowl. A plurality of toilet seat covers are generally packaged stacked together in a single pile inside the packet, and the sometimes the sheets are also folded. A user uses the toilet seat cover by removing the seat cover from the packet. The removing is generally done by pulling a sheet or more of the toilet seat cover away from the packet and toward the user. After the seat cover is pulled from the packet, the user then set the toilet seat cover on the toilet seat before sitting down.

The present invention provides a fragrance discharging device, and the fragrance is discharged during the pulling and setting of the toilet seat cover by a user. In particular, the fragrance is discharged when the user pulls a toilet seat cover from the packet and sets the toilet seat cover on the toilet seat.

The present invention provides a scent reservoir within the toilet seat cover package wherein the force of the user's pulling of the toilet seat cover from the packet causes discharging of the fragrance particles into the area surrounding the toilet bowl. Still further objects and advantages will become apparent from a consideration of the ensuing description and drawings.

SUMMARY OF INVENTION

The present invention is a fragrance discharging toilet seat cover dispensing device. The device generally includes a retainer for holding the toilet seat covers and at least one scent reservoir. The retainer comprises at least one wall, wherein the scent reservoir is disposed in the inside of the retainer. At least one opening is also disposed in the retainer and defines an opening for dispensing the seat covers and discharging the fragrance.

The retainer can be in various shapes, such as circular, triangle, or rectangular shape. When the retainer is in a triangular or rectangular shape, the retainer can have several walls. When the retainer is in a circular or allantoidal shape, the retainer wall can be a one continuous piece that encloses the entire retainer. Also, when packaged inside a circular or allantoidal shaped retainer, the toilet seat covers can be stacked and the stack appropriately rolled, or the toilet seat covers can be in a continuous roll, such as the toilet paper. In the illustrated embodiment herein below, the retainer is in a semi-allantoidal shape, such as a pillow, and the toilet seat covers are in a stacked pile.

The scent reservoir preferably comprises at least one exposed surface for the fragrance particles to egress the reservoir. The scent reservoir having suitable fragrance particles is capable of releasing the fragrance particles when its exposed surface is irritated, such as by chafing or rubbing. In the preferred embodiment, the fragrance particles in the scent reservoir are an arid type of particle. Further in the preferred embodiment, the scent reservoir is disposed on the inner side of the wall where the opening is also disposed, and the exposed surface is positioned away from the wall.

A plurality of toilet seat covers is packed in a pile and disposed inside the retainer. The pile has at least one outer most seat cover. In the preferred embodiment, the pile of seat covers is positioned immediately behind the scent reservoir, so that the outer most seat cover is in contact with the exposed surface of the reservoir. The device in accordance with the present invention therefore enables at least one seat cover, that is, the outer most seat cover, to be in contact with the scent reservoir, and also partially exposed to outside through the opening.

In the process of usage of the seat cover, a user removes the seat cover from the retainer by pulling the outer most seat cover through the opening. The pull causes sliding of the outer most seat cover against the exposed surface of the scent reservoir, which creates friction between the exposed surface of the scent reservoir and the outer most seat cover. The friction enables the fragrance particles to be released from the scent reservoir. The pull of the seat cover simultaneously creates a negative pressure inside the retainer which causes the ambient air to flow into the retainer.

As the air inflows into the retainer, it mixes with the released fragrance particles from the scent reservoir. The continued pull however, causes the momentum gain of the air surrounding the scent reservoir in the direction of the pull. As the pull continues, the negative pressure inside the retainer diminishes, and the fragrance-mixed inside air eventually begins to rush out through the opening. This rushing out of scented air causes a disbursement of fragrance into the ambient air.

Also during the pull of the seat cover, the seat cover rubs off an amount of the fragrance particles, which adheres to the surface of the pulled out seat cover. The user's subsequent action of moving the toilet seat cover from the retainer to the toilet bowl causes wavering of the seat cover in the ambient air. The turbulence from the wavering causes unsettling of the fragrance particles on the surface of the pulled out seat cover to be disbursed in the space around the toilet bowl, so that the fragrance further disburses into the ambient air.

BRIEF DESCRIPTION OF THE DRAWINGS

The present invention and the objects and advantage thereof will become more obvious from the following description when taken in light with the accompanying drawings wherein like reference numerals denote like elements and in which.

DETAILED DESCRIPTION

Figure 1:
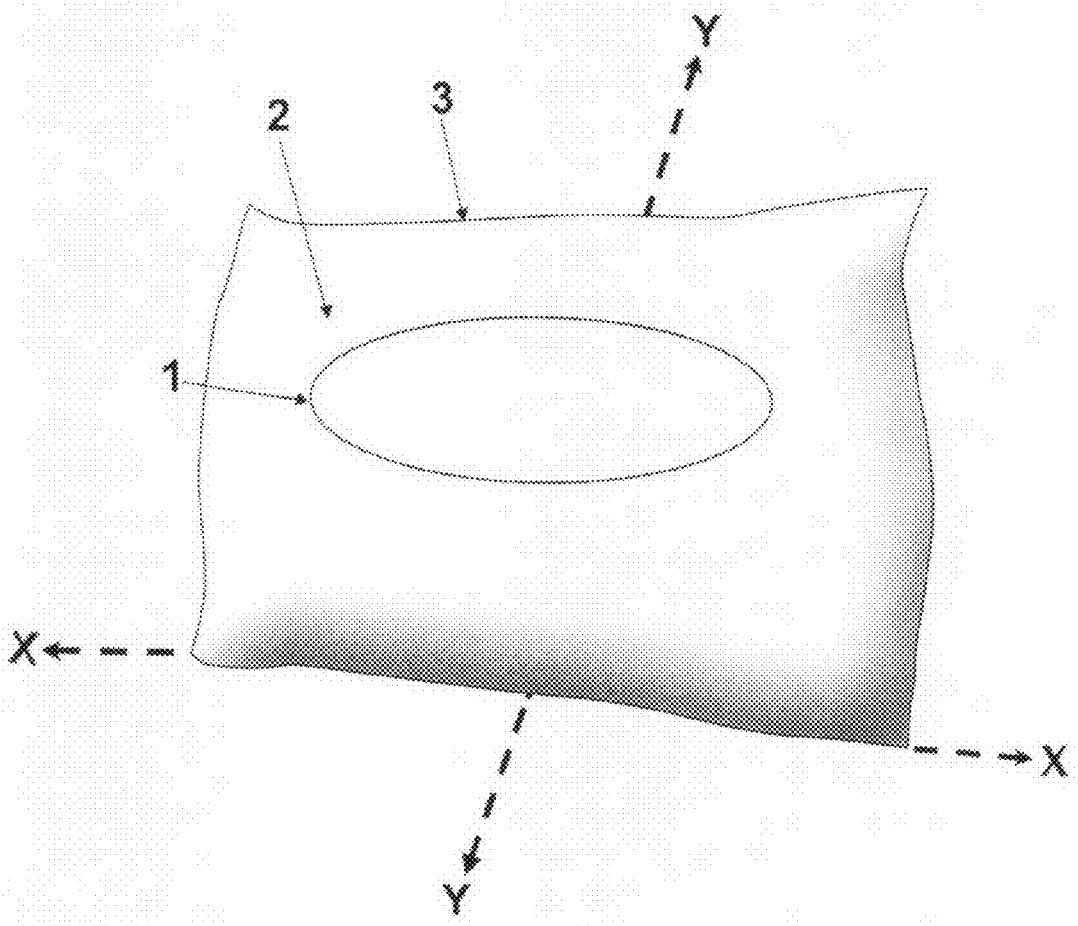
FIG. 1 is an perspective view of a device for fragrance discharging toilet seat cover dispensing device in accordance with the present invention generally showing a retainer, which comprises walls and an opening.
Figure 2:
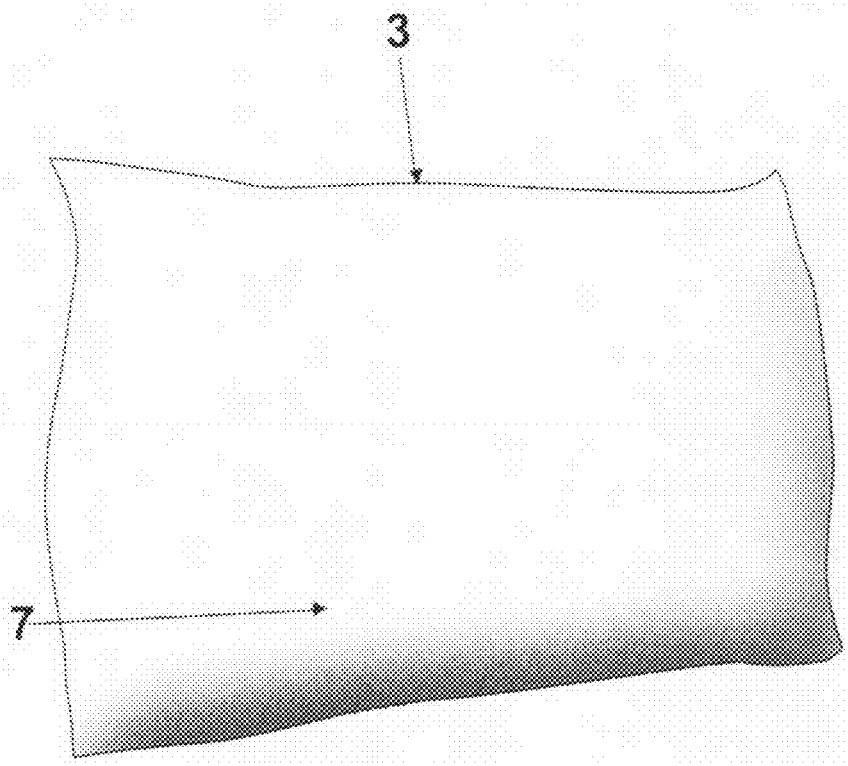
FIG. 2 is a perspective view of rear of the device.

Turning to FIG. 1 and FIG. 2, an example of a device for fragrance discharging toilet seat cover dispensing device, in accordance with the present invention, is shown. FIG. 2 is the rear view of the device. The device generally comprises a retainer 3 with a front wall 2 and a rear wall 7. Notice that unlike the illustrated embodiment, in a circular or allantoidal shaped retainer, the front wall 2 and the rear wall 7 can be a one continuous piece. The walls may be formed from any suitable material. In the preferred embodiment, the walls 2 and 7 are generally composes of materials such as plastic or cardboard paper.

The wall 2 generally includes an opening 1 which provides a means for dispensing the seat covers and discharging the fragrances. During the usage, the retainer 3 is generally positioned either horizontally or vertically. In the illustrated embodiment, the device is vertically positioned.

Figure 3:
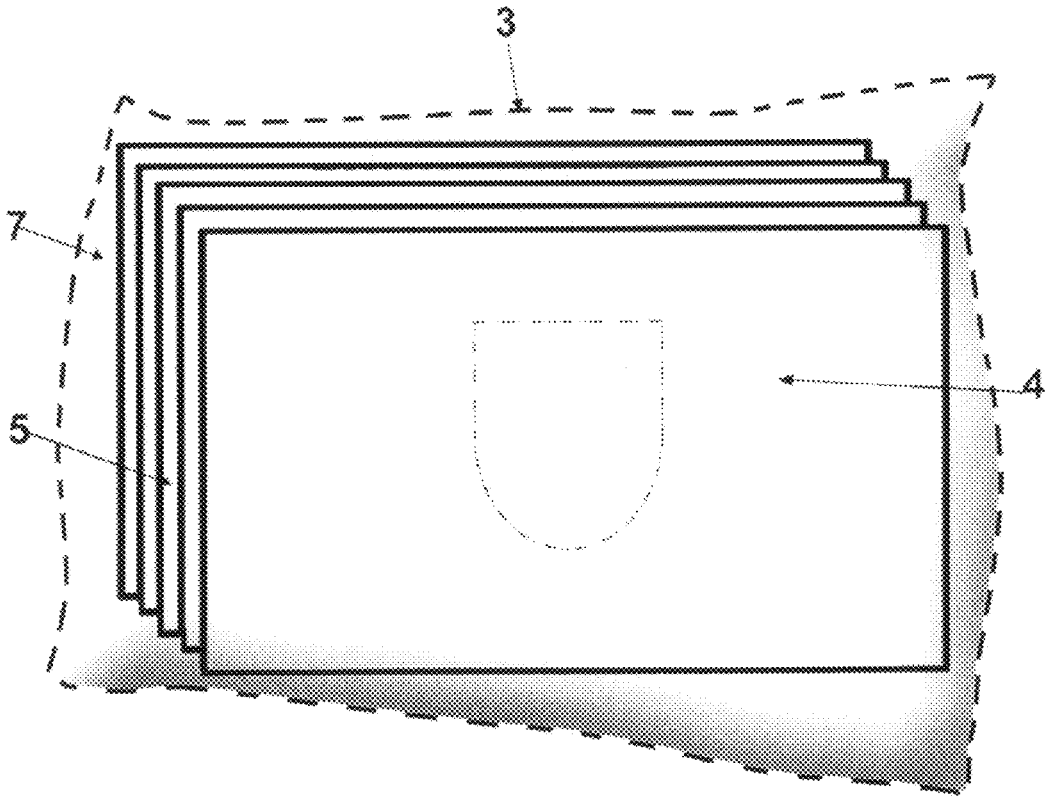
FIG. 3 is a cross-sectional view of the device, taken across line x-x of FIG. 1, where a pile of toilet seat covers is disposed inside the retainer and the wall of the retainer with the opening removed.

FIG. 3 shows a cross sectional view of the retainer 3 with the wall 2 removed. For the purpose of the description, a plurality the toilet seat covers are stacked and disposed inside the device. The compositions and functionality of the toilet seat covers are not described in detail herein, as such details are well known and are not within the scope of the present invention. As shown in FIG. 3, the seat covers are stacked in a pile 5 so that the pile 5 has at least one outer most seat cover 4. The pile of seat covers 5 are packaged so that the outer most seat cover can be separated from the rest of the pile 5 by a simple pull of the outer most seat cover 4.

Figure 4:
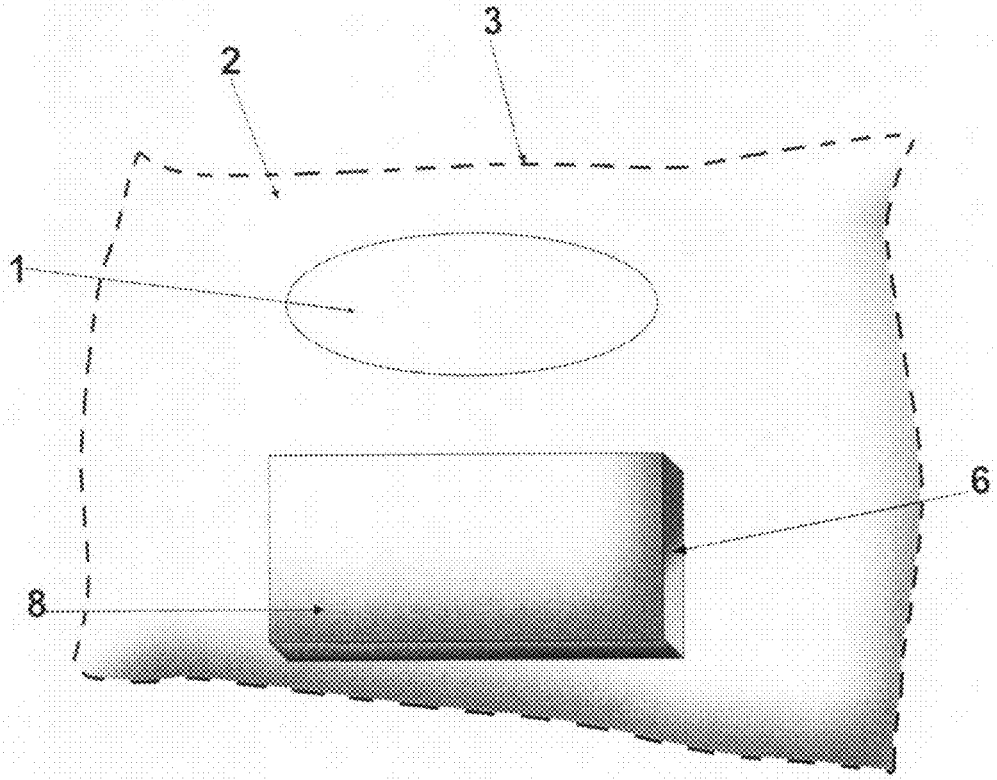
FIG. 4 is a perspective view of rear of the wall with opening.

Referring now to FIG. 4, the scent reservoir 6 has at least one exposed surface 8 which provides means for the fragrance particles to egress then reservoir. The scent reservoir 6 can be disposed in any suitable place inside the retainer 3. In the illustrated embodiment, the scent reservoir 6 is disposed on the inner side of the wall 2. Note that unlike the illustrated embodiment, in a circular or allantoidal shaped retainer, since the walls can be a one continuous piece, the scent reservoir can be disposed on inner side of any appropriate part of the continuous wall. The scent reservoir 6 may be composed of wick material with suitable arid fragrance particles. The scent reservoir 6 may releases the fragrance particles when its exposed surface 8 is irritated, such as by a slight rubbing or by chafing. The functionality and the assembly of the scent reservoir are not described in detail herein, as such details are well known and are not considered a part of the present invention.

Figure 5:
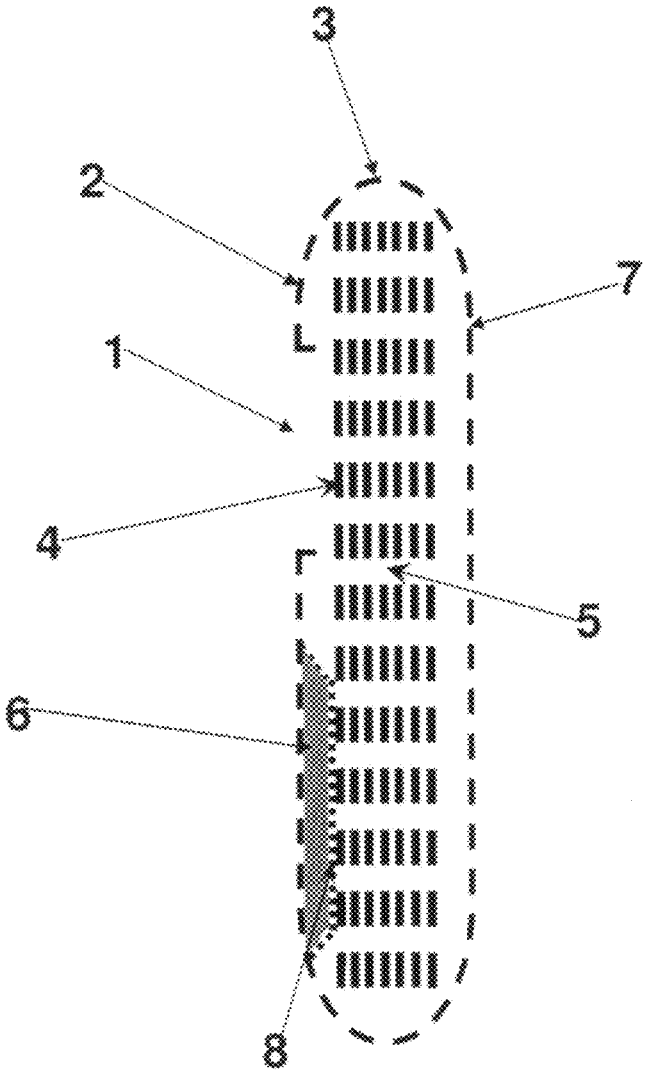
FIG. 5 is a cross-sectional view of the device, taken across line y-y of FIG. 1, where a pile of toilet seat covers is disposed inside the retainer.

FIG. 5 illustrates the cross sectional view of the seat cover pile 5 positioned inside the retainer 3. As shown in FIG. 5, when the walls 2 and 7 of the retainer 3 are assembled, the seat cover pile 5 is disposed immediately behind the scent reservoir 6, and at least a part of the outer most seat cover 4 is in contact with the exposed surface 8. The outer most seat cover 4 is also partially exposed to the outside through the opening 1. The outer most seat cover 4 can be remove from the pile 5 by reaching into the inside of the retainer 3 through the opening 1 and pulling the outer most seat cover 4 away from the pile 5.

Figure 6:
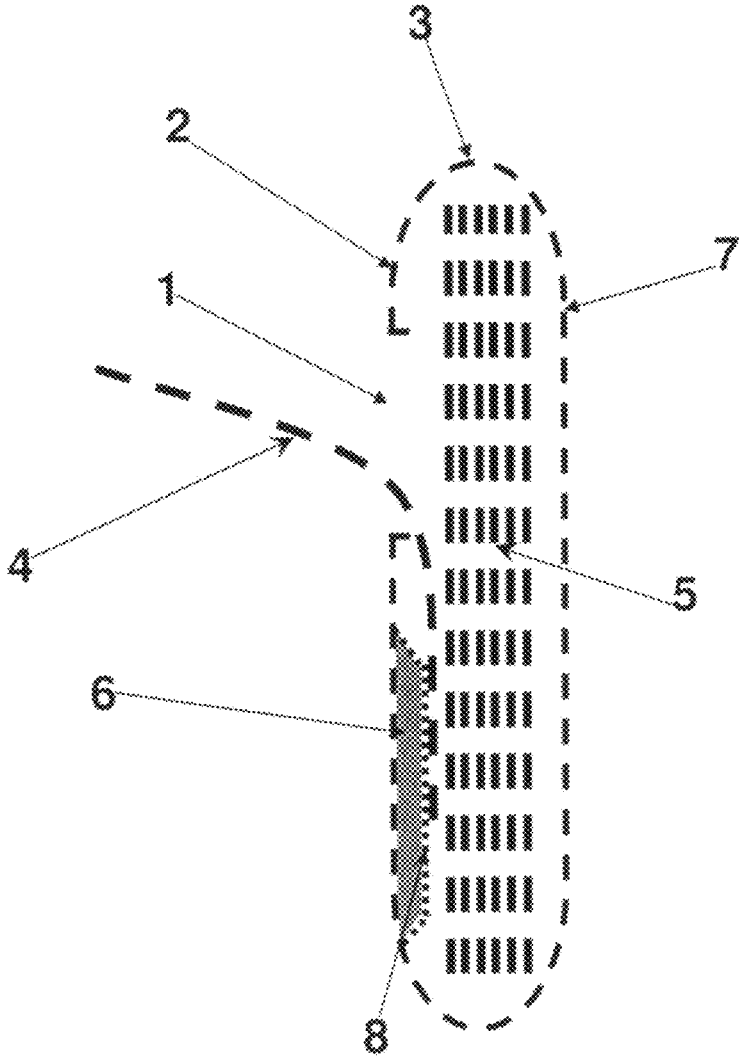
FIG. 6 is a cross-sectional view of the device, taken across line y-y of FIG. 1 with one sheet of seat cover partially pulled out and protruding from the opening.

FIG. 6 shows the outer most seat cover 4 partially pulled out and protruding from the opening 1. As shown by the protruding seat cover 4 in FIG. 6, the sliding of the outer most seat cover 4 against the expose surface 8 during the pull causes friction between the outer most seat cover 4 and the expose surface 8, which facilitates the release of fragrance particles from the scent reservoir 6.

The operation of the present invention with the above embodiments is as follows: in the process of usage of the seat cover, a user removes a seat cover from the device by reaching into the opening 1 and pulling the outer most seat cover 4 away from the retainer 3. During the pulling, the sliding movement of the outer most seat cover 4 across the exposed surface 8 of the scent reservoir 6 creates friction and enables the scent reservoir 6 to release the fragrance particles to its immediate surrounding area. The initial sliding of the outer most seat cover 4 from the pile 5 simultaneously creates a negative pressure in the surrounding area of the scent reservoir 6, which causes the inflow of the ambient air into the retainer 3 through the opening 1. As the ambient air ingresses into the surrounding areas, it mixes with the fragrance particles released from the scent reservoir.

The pull of the seat cover 4 however, causes the momentum gain of the air surrounding the scent reservoir 6 in the direction of the pull. As the pull continues, the negative pressure inside the retainer diminishes, and as the fragrance-mixed inside air gains more momentum from the pull, it eventually begins to rush out of the retainer 3 through the opening 1. This rushing out of scented air discharges a disbursement of fragrance into the ambient air of the toilet.

Additionally, during the sliding of the seat cover 4 against the exposed scent reservoir surface 8, some fragrance particles from the scent reservoir 6 are rubbed off to the surfaces of the outer most seat cover 4. Due to thinness of the seat cover 4, the user's subsequent action of moving the seat cover 4 from the retainer 3 to the toilet bowl causes the wavering of the seat cover 4 in the space above the toilet bowl. The turbulence from the wavering causes unsettling of the fragrance particles on the surfaces of the seat cover 4 to be disbursed into the space around the toilet bowl, so that the fragrance further discharges into the ambient air.

Although there has been hereinabove described a device for fragrance discharging toilet seat cover dispensing device in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in art, should be considered to be within the scope of the present invention as defined in the appended claims.

What is claimed is:

1. A device for fragrance discharging toilet seat cover dispensing comprising:

a retainer having at least one wall, the retainer configured to hold a plurality of toilet seat covers;

at least one opening disposed in at least one wall; and at least one scent reservoir disposed inside of the retainer, wherein, the retainer and the at least one scent reservoir are configured for at least one of the plurality of toilet seat covers when held by the retainer to be in contact with the at least one scent reservoir, and removal of the at least one toilet seat cover from the plurality of seat covers through the opening releases fragrance particles from the at least one scent reservoir into ambient air, and wherein the plurality of toilet seat covers is positioned immediately behind the at least one scent reservoir.

2. The device of claim 1, wherein the scent reservoir is disposed on at least one wall.

3. The device of claim 1, wherein removal of the at least one toilet seat cover through the opening releases fragrance particles from the scent reservoir into ambient air by rubbing.

4. The device of claim 1, wherein removal of the at least one toilet seat cover through the opening releases fragrance particles from the scent reservoir into ambient air by chafing.

5. The device of claim 1, wherein the retainer and scent reservoir are configured such that when a toilet seat cover is removed through the opening, the toilet seat cover is pulled toward the scent reservoir.

6. The device of claim 1 or 2, wherein the scent reservoir and the opening are disposed on the same wall.

* * * * *